US009583876B2

(12) United States Patent
Sekino

(10) Patent No.: US 9,583,876 B2
(45) Date of Patent: Feb. 28, 2017

(54) CONNECTOR LOCKING MECHANISM

(71) Applicant: YAZAKI CORPORATION, Minato-ku, Tokyo (JP)

(72) Inventor: Tetsuya Sekino, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/953,465

(22) Filed: Nov. 30, 2015

(65) Prior Publication Data

US 2016/0156130 A1 Jun. 2, 2016

(30) Foreign Application Priority Data

Dec. 1, 2014 (JP) ..... 2014-242820

(51) Int. Cl.

| | |
|---|---|
| ***H01R 13/62*** | (2006.01) |
| ***H01R 13/629*** | (2006.01) |
| *H01R 13/627* | (2006.01) |
| *H01R 13/633* | (2006.01) |

(52) U.S. Cl.

CPC ... *H01R 13/62933* (2013.01); *H01R 13/6272* (2013.01); *H01R 13/633* (2013.01)

(58) Field of Classification Search

CPC ..... H01R 13/6272; H01R 13/62933
USPC ..... 439/357, 358
See application file for complete search history.

(56) References Cited

U.S. PATENT DOCUMENTS 6,146,183 A * 11/2000 Jinno ..... H01R 13/6272 439/358
6,669,398 B2 * 12/2003 Wada ..... C08J 9/0004 403/322.4
7,033,201 B2 * 4/2006 Ichida ..... H01R 13/633 439/352
7,056,142 B2 * 6/2006 Ueda ..... H01R 13/6272 439/328
7,160,134 B2 * 1/2007 Ichida ..... H01R 13/633 439/352
7,229,306 B2 * 6/2007 Mase ..... H01R 13/6272 439/354
7,682,181 B1 * 3/2010 Jones, Jr. ..... H01R 13/6272 439/352

(Continued)

FOREIGN PATENT DOCUMENTS

JP S63-37089 U 3/1988
JP 2001-250636 A 9/2001

(Continued)

OTHER PUBLICATIONS

Office Action issued on Dec. 6, 2016 in the counterpart Japanese patent application.

*Primary Examiner* — Ross Gushi
(74) *Attorney, Agent, or Firm* — Mots Law, PLLC

(57) ABSTRACT

With leverage of a second arm, in a connector locking mechanism that releases a lock of a first arm that corresponds to a locking arm body, a working face of a supporting portion of the second arm is arranged on an upper surface of an upper wall portion of a fitting hood portion of a second connector housing. The fitting hood portion fits with respect to a first connector housing. The working face of the supporting portion of each of a pair of the second arms is arranged so as to be a plane perpendicular to a pressing-down direction of an operating end of each of the second arms.

3 Claims, 13 Drawing Sheets

(56) References Cited

U.S. PATENT DOCUMENTS

| | | | | |
|---|---|---|---|---|
| 8,882,528 | B2 * | 11/2014 | Sasho | H01R 13/6272 439/358 |
| 9,203,190 | B2 * | 12/2015 | Hamai | H01R 13/6272 |
| 2001/0035652 | A1 * | 11/2001 | Wada | C08J 9/0004 292/128 |
| 2002/0111060 | A1 * | 8/2002 | Challis | H01R 13/6272 439/352 |
| 2005/0082840 | A1 * | 4/2005 | Ichida | H01R 13/633 292/66 |
| 2006/0105611 | A1 * | 5/2006 | Toyoda | H01R 13/6272 439/353 |
| 2013/0005172 | A1 * | 1/2013 | Ohyama | H01R 12/79 439/350 |
| 2014/0179146 | A1 * | 6/2014 | Hamai | H01R 13/639 439/357 |
| 2016/0156130 | A1 * | 6/2016 | Sekino | H01R 13/62933 439/345 |
| 2016/0164224 | A1 * | 6/2016 | Sekino | H01R 13/6272 439/352 |

FOREIGN PATENT DOCUMENTS

| | | | |
|---|---|---|---|
| JP | 2003-308923 | A | 10/2003 |
| JP | 2003-308925 | A | 10/2003 |

* cited by examiner

CONNECTOR LOCKING MECHANISM

CROSS REFERENCE TO RELATED APPLICATIONS

This application claims the priority of Japanese Patent Application No. 2014-242820, filed on Dec. 1, 2014, the entire content of which are incorporated herein by reference.

BACKGROUND

Technical Field

The present invention relates to a connector locking mechanism in which a lock releasing arm that releases a lock by leverage is integrally formed with a locking arm integrally formed with a connector housing.

Related Art

FIGS. 18 to 20A and 20B illustrate connector locking mechanisms in the related art described in JP 2001-250636 A.

FIG. 18 is a perspective view of an external configuration of a locking arm only taken out of the connector locking mechanism in the related art. FIG. 19 is a partial longitudinal cross-sectional view of a first connector housing including a locking arm arranged therein. FIGS. 20A and 20B are partial longitudinal cross-sectional views illustrating the first connector housing and a second connector housing that have fitted into each other, and the first connector housing and the second connector housing that have been detached from each other, respectively.

As illustrated in FIGS. 20A and 20B, the rocking mechanism is arranged between the first connector housing 11 of a first connector 10 and the second connector housing 21 of a second connector 20 that have fitted into each other. The locking mechanism includes the locking arm 30 arranged toward the first connector housing 11 and a locking protrusion 25 arranged toward the second connector housing 21.

For convenience, a fitting direction and a fitting releasing direction between the first connector housing 11 and the second connector housing 21 as longitudinal direction and directions that are perpendicular to the longitudinal direction and are perpendicular to each other as vertical direction and lateral direction, will be described. Note that, three pairs of directions illustrated in FIGS. 18 to 20B (front, rear, left, right, up, and down) are based on the first connector housing 11.

As illustrated in FIGS. 19, 20A and 20B, the locking arm 30 has been arranged flexible in the vertical direction, on the upper side of an upper wall 14 of the first connector housing 11.

Meanwhile, as illustrated in FIGS. 20A and 20B, the locking protrusion 25 has been arranged so as to protrude on the upper side of an upper wall portion of a fitting hood portion 22 of the second connector housing 21. The locking protrusion 25 engages with the locking arm 30 by using flexure of the locking arm 30 when the first connector housing 11 and the second connector housing 21 fit into each other. In an engaging state illustrated in FIG. 20B, the locking protrusion 25 generates locking force for preventing the first connector housing 11 and the second connector housing 21 from moving in the fitting releasing direction (backward).

As illustrated in FIGS. 18 and 19, the locking arm 30 includes a first arm 32 and a second arm 40. The first arm 32 corresponds to a locking arm body. The second arm 40 corresponds to a lock releasing arm and is integrally formed so as to bend back from a top end of the first arm 32.

The first arm 32 is a cantilever arm that extends a free end 34 forward from a fixing end 31 that has been fixed on an upper wall 14 of the first connector housing 11. The free end 34 is displaceable in the vertical direction due to flexibility of the arm.

The second arm 40 includes a loading end 41, an operating end 42, and a supporting portion 45. The loading end 41 to be a point of load of a lever is coupled to the free end 34 of the first arm 32. The operating end 42 to be a point of effort of the lever extends backward from the loading end 41 so as to be arranged at a rear end. The supporting portion 45 to be a fulcrum of the lever is arranged on a lower surface between the operating end 42 and the loading end 41.

An engaging recess portion 33 with which the locking protrusion 25 is engaged, and a locking wall portion 35 positioned on the front side of the engaging recess portion 33 are arranged at the free end 34 of the first arm 32. The loading end 41 of the second arm 40 is integrally formed with the locking wall portion 35 arranged at the free end 34 of the first arm 32.

As illustrated in 20A, the locking wall portion 35 of the first arm 32 slides with respect to the locking protrusion 25 in accordance with a fitting between the first connector housing 11 and the second connector housing 21. The first arm 32 bends upward so that the free end 34 of the first arm 32 is displaced upward. In accordance with progress of the fitting between the first connector housing 11 and the second connector housing 21, the locking wall portion 35 of the first arm 32 further gets over the locking protrusion 25. The locking protrusion 25 engages with the engaging recess portion 33 due to return operation of the flexure of the first arm 32 after the locking wall portion 35 of the first arm 32 gets over the locking protrusion 25. Accordingly, the locking wall portion 35 of the first arm 32 serves to generate locking force for preventing the first and second connector housings 11 and 21 from being detached, between the locking wall portion 35 of the first arm 32 and the locking protrusion 25.

As illustrated in FIGS. 20 A and 20B, the locking mechanism presses the operating end 42 of the second arm 40 down as illustrated in an arrow N1 so as to rock the second arm 40 with, as the fulcrum P, a contact point with a working face on the first connector housing 11 of the supporting portion 45. Furthermore, leverage of the second arm 40 lifts the free end 34 (locking wall portion 35) of the first arm 32 coupled to the loading end 41 on the opposite side of the operating end 42 interposing the fulcrum P so as to release the engagement of the locking protrusion 25 with respect to the engaging recess portion 33.

Note that, before the releasing operation, the supporting portion 45 of the second arm 40 floats with a gap d with respect to the working face on the first connector housing 11. When the releasing operation is performed, the supporting portion 45 of the second arm 40 abuts on the working face on the first connector housing 11 so as to serve as the fulcrum P of the rocking.

SUMMARY

In the above locking mechanism in the related art, a position of the working face of the supporting portion 45 of the second arm 40 is arranged so as to be on the upper wall 14 of the first connector housing 11 itself. Therefore, as illustrated in FIG. 19, a distance H1 between the fulcrum (supporting portion 45) and the point of effort (operating end 42) need to shorten.

In a case where the leverage of the second arm 40 lifts the free end 34 of the first arm 32 (locking wall portion 35), when a ratio H1/H2 (lever ratio) of the distance H1 between the fulcrum (supporting portion 45) and the point of effort (operating end 42) to a distance H2 between the fulcrum (supporting portion 45) and the point of load (loading end 41) is large, small operating force (pressing-down force applied to the operating end 42 of the second arm 40) can release the lock.

However, in a case of the above example in the related art, since the position of the working face of the supporting portion 45 of the second arm 40 is arranged on the first connector housing 11 itself, the distance H1 between the fulcrum (supporting portion 45) and the point of effort (operating end 42) shortens. Accordingly, there is a problem that the operating force for releasing the lock increases and workability for releasing the lock degrades.

The present invention has been made in consideration of the above situation. An object of the present invention is to provide a connector locking mechanism capable of improving workability for releasing a lock.

A connector locking mechanism according to one aspect of the present invention, in which an operating end of a second arm is pressed down so as to slide the second arm with a contact point with a working face on a second connector housing of a supporting portion as a fulcrum and lift a free end of a first arm that is coupled to a loading end on an opposite side of an operating end interposing the fulcrum, with leverage of the second arm, and release engagement of a locking protrusion with respect to an engaging recess portion, includes, in a case where a fitting direction and a fitting releasing direction of a first connector housing and the second connector housing that fit into each other are defined as longitudinal direction and directions that are perpendicular to the longitudinal direction and are perpendicular to each other are defined as vertical direction and lateral direction, a locking arm arranged on an upper side of an upper wall of the first connector housing so as to be flexible in the vertical direction, and the locking protrusion arranged so as to protrude on an upper side of an upper wall of the second connector housing, configured to engage with the locking arm using flexure of the locking arm when the first connector housing and the second connector housing fit into each other, and configured to generate locking force for preventing the first connector housing and the second connector housing from moving in the fitting releasing direction in the engaging state. The locking arm integrally includes a first cantilever arm extending the free end forward from a fixing end fixed on the upper wall of the first connector housing so that the free end is displaceable in the vertical direction due to flexibility of the arm; and the second arm in which the loading end to be a point of load of a lever at the free end of the first arm is coupled to the second arm, the operating end extends backward from the loading end, and is arranged so as to be a point of effort of the lever at a rear end, and the supporting portion is arranged so as to be a fulcrum of the lever on a lower surface between the operating end and the loading end. The free end of the first arm includes the engaging recess portion configured to engage with the locking protrusion, and an engaging wall portion positioned on a front side of the engaging recess portion, configured to slide with respect to the locking protrusion in accordance with a fitting between the first connector housing and the second connector housing so that the first arm bends upward and the free end of the first arm is displaced upward, configured to get over the locking protrusion in accordance with progress of the fitting between the first connector housing and the second connector housing, and configured to engage the locking protrusion with the engaging recess portion due to return operation of the flexure of the first arm after the engaging wall portion gets over the locking protrusion so as to generate the locking force between the locking protrusion and the engaging wall portion. The working face of the supporting portion of the second arm is arranged on an upper surface of the upper wall of the second connector housing, the upper wall fitting with respect to the first connector housing.

The connector locking mechanism according to one aspect of the present invention may include the working face of the supporting portion of the second arm arranged on an upper surface of an upper wall of a fitting hood portion of the second connector housing, the fitting hood portion fitting into an external circumference of a housing body of the first connector housing.

The connector locking mechanism according to one aspect of the present invention may include a pair of the second arms arranged on both outsides of the first arm in the lateral direction, operating ends of the pair of the two second arms are integrally coupled to each other, and the working face of the supporting portion of each of the pair of the second arms is arranged so as to be a plane perpendicular to a pressing-down direction of the operating end of each of the second arms.

According to one aspect of the present invention, a working face of a supporting portion of a second arm is arranged on an upper surface of an upper wall of a second connector housing, and is not arranged on a first connector housing that includes a locking arm arranged thereon. The upper wall fits with respect to the first connector housing. Thus, a position of a fulcrum that rocks the second arm can be arranged to be at a position that is away from an operating end as a point of effort and is close to a loading end as a point of load.

Accordingly, a distance between the operating end (point of effort) that adds pressing-down operating force for releasing a lock, and the fulcrum, can be arranged to be long. In addition, a distance between the loading end (point of load) coupled to a locking wall portion of a free end of a first arm, and the fulcrum, can be arranged to be short. As a result, a lever ratio can increase and the operating force for releasing the lock can be reduced. Workability for releasing the lock can be improved.

According to one aspect of the present invention, in a case where the working face is arranged on an upper surface of an upper wall of a fitting hood portion, the distance between the point of effort and the fulcrum can be arranged as long as possible, and the distance between the point of load and the fulcrum can be arranged to be as short as possible, by simply changing the configuration. As a result, the operating force for releasing the lock can be further reduced.

According to one aspect of the present invention, in a case where the working face of the supporting portion of the second arm is arranged so as to be a plane, a working position hardly move and a pulling-up margin of the free end of the first arm for releasing the lock (locking wall portion) does not vary. Therefore, the first arm can be stably pulled up upon the release of the lock and the lock can be stably released. Even when the working position of the supporting portion of the second arm moves, since the pulling-up margin of the free end of the first arm for releasing the lock (locking wall portion) can be stably secured. Therefore, stability of lock releasing operation can be achieved.

DETAILED DESCRIPTION

An embodiment of the present invention will be described below with reference to the drawings.

Figure 1:
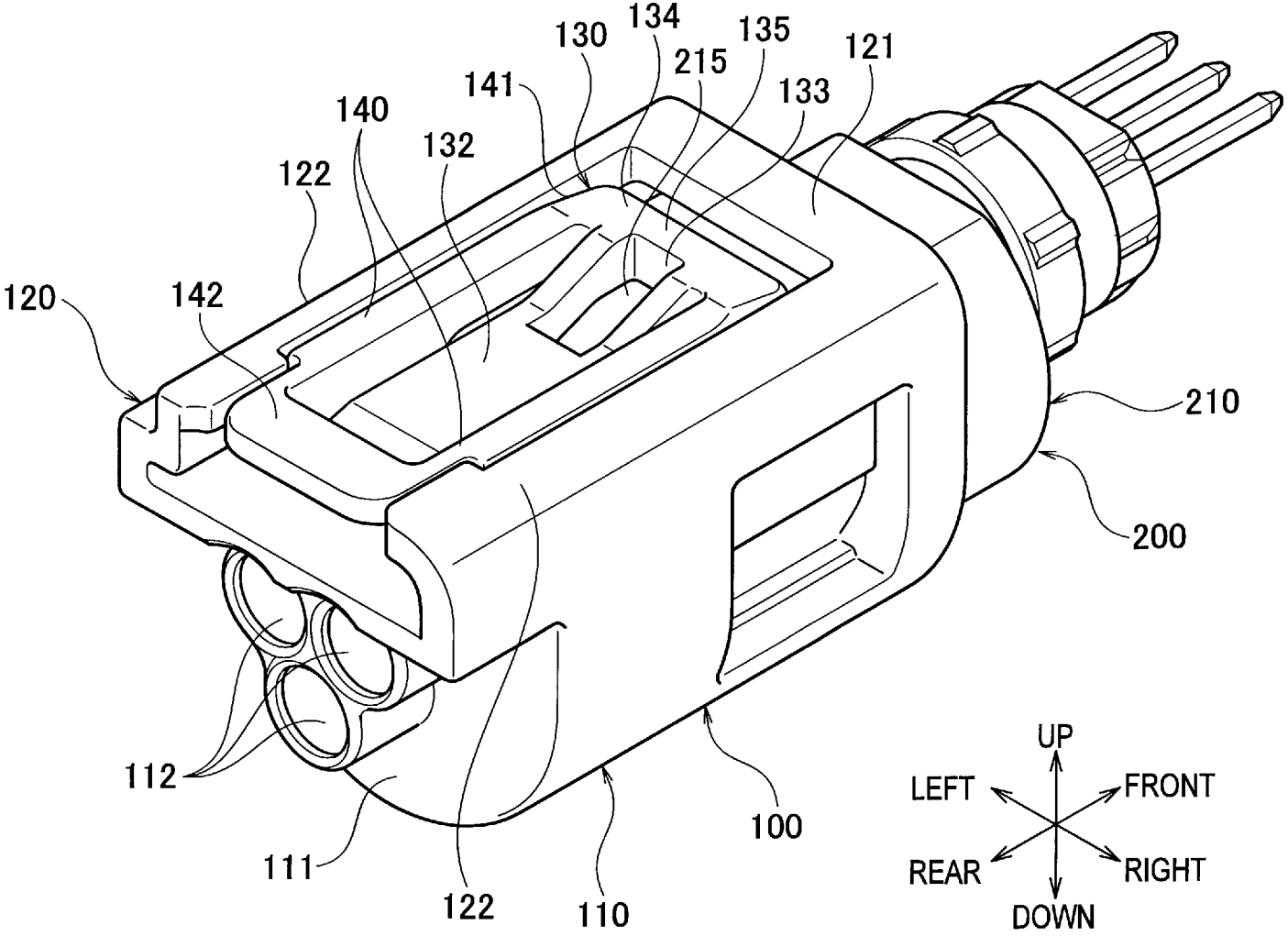
FIG. 1 is a perspective view of a connector including a locking mechanism according to an embodiment of the present invention when the connector fits.
Figure 2:
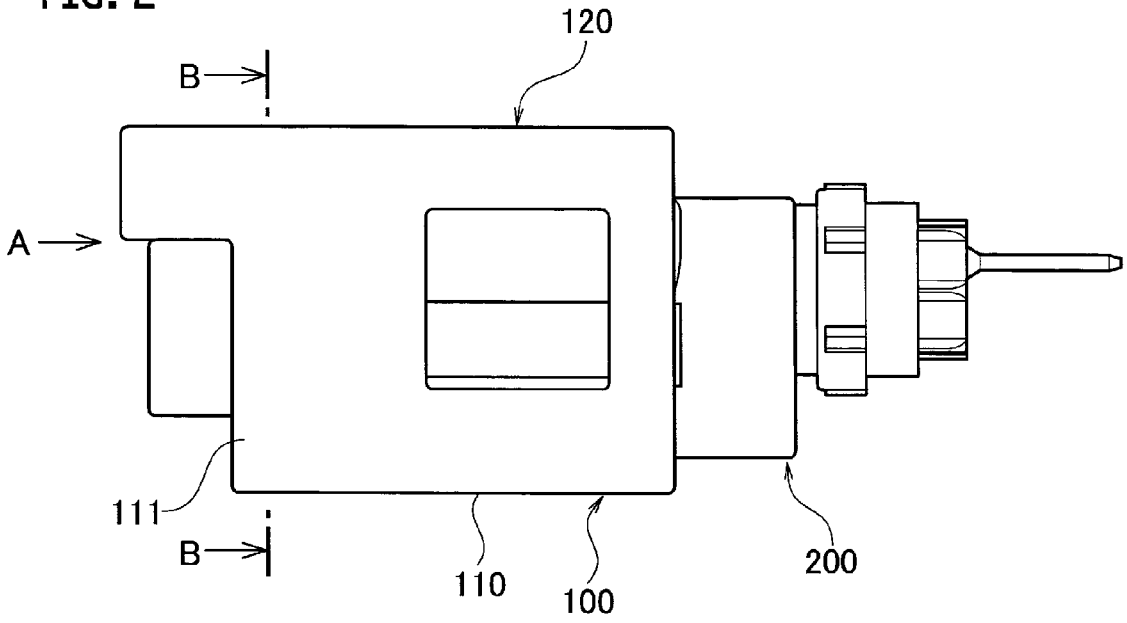
FIG. 2 is a side view of the connector including the locking mechanism according to the embodiment of the present invention when the connector fits.
Figure 3:
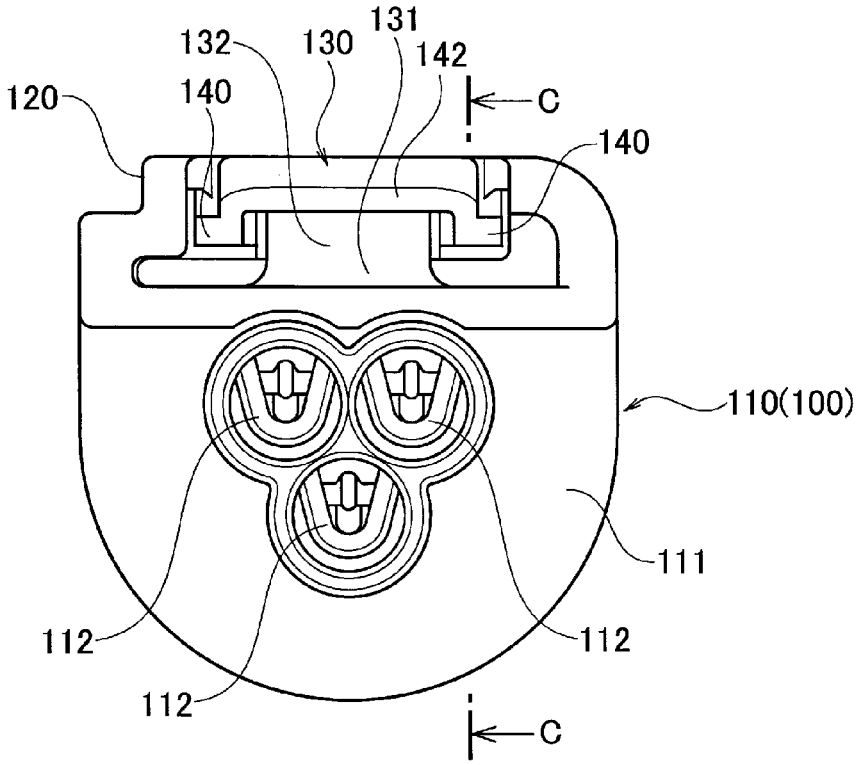
FIG. 3 is a view on arrow A of FIG. 2.
Figure 4:
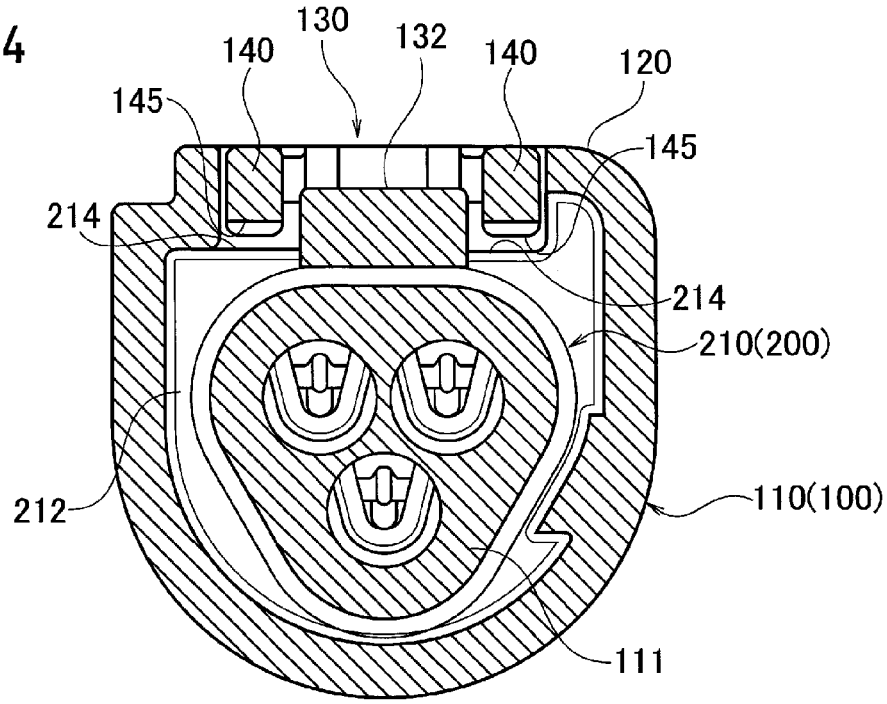
FIG. 4 is a cross-sectional view viewed along arrows B-B of FIG. 2.
Figure 5:
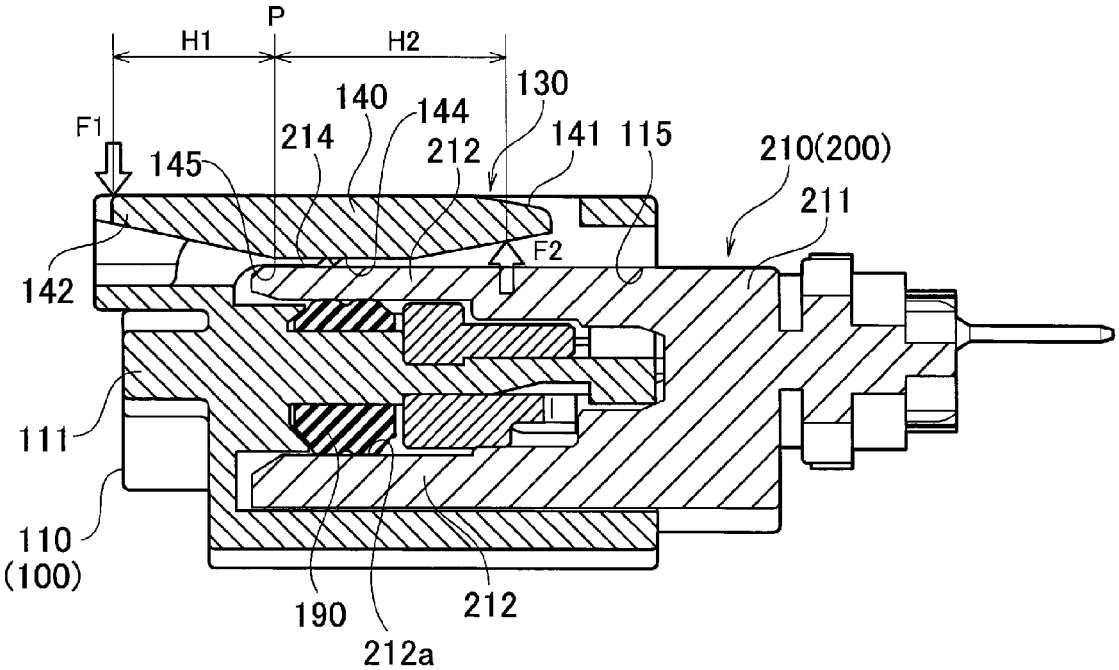
FIG. 5 is a cross-sectional view viewed along arrows C-C of FIG. 3.
Figure 6B:
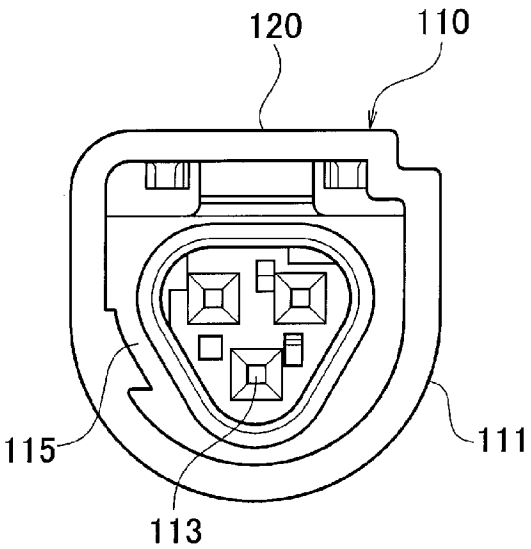
FIGS. 6 A, 6B, and 6C are a side view, a front view, and a rear view of a configuration of a first connector housing in which a locking arm included in the locking mechanism according to the embodiment of the present invention is arranged, respectively.
Figure 6A:
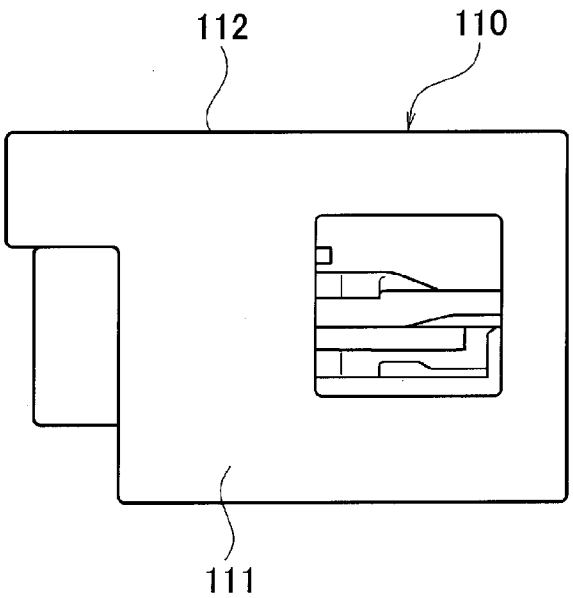
Figure 6C:
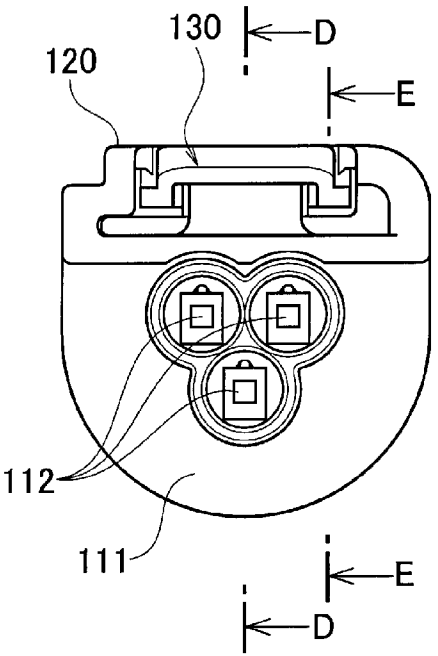
Figure 7:
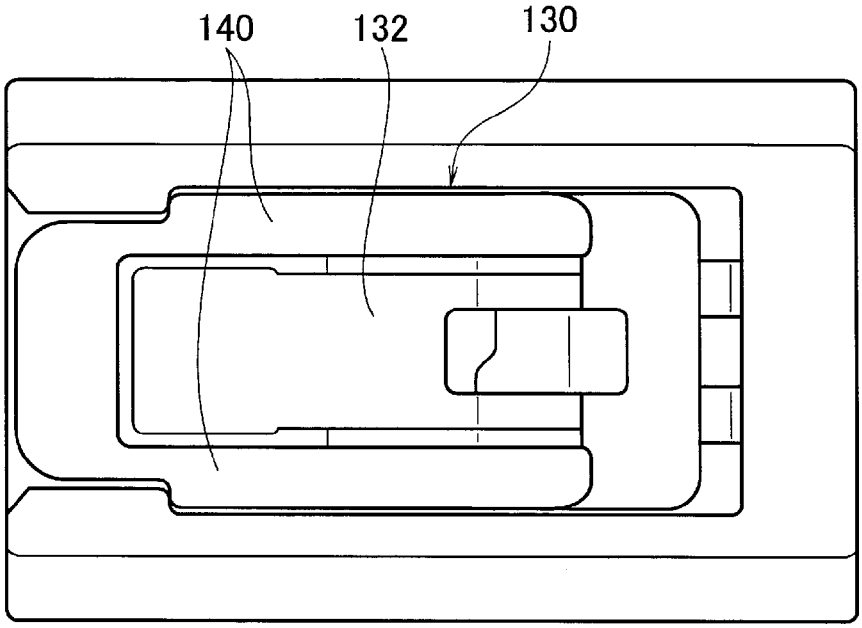
FIG. 7 is a top view of the first connector housing.
Figure 8:
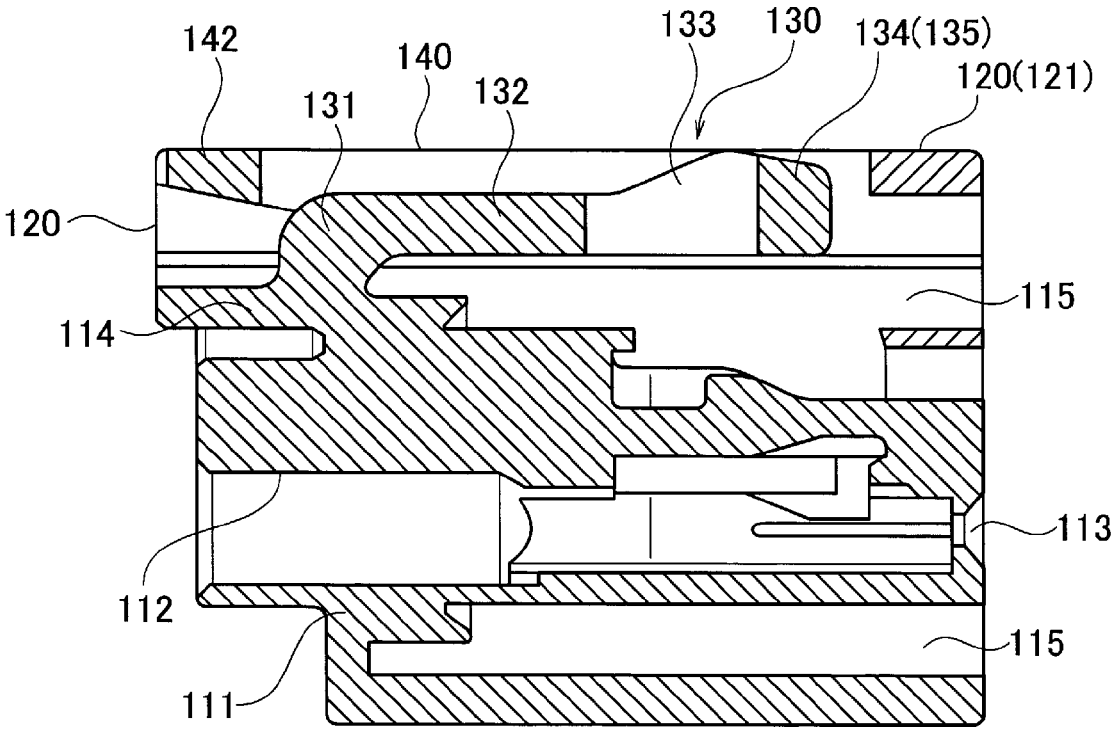
FIG. 8 is a cross-sectional view viewed along arrows D-D of FIG. 6C.
Figure 9:
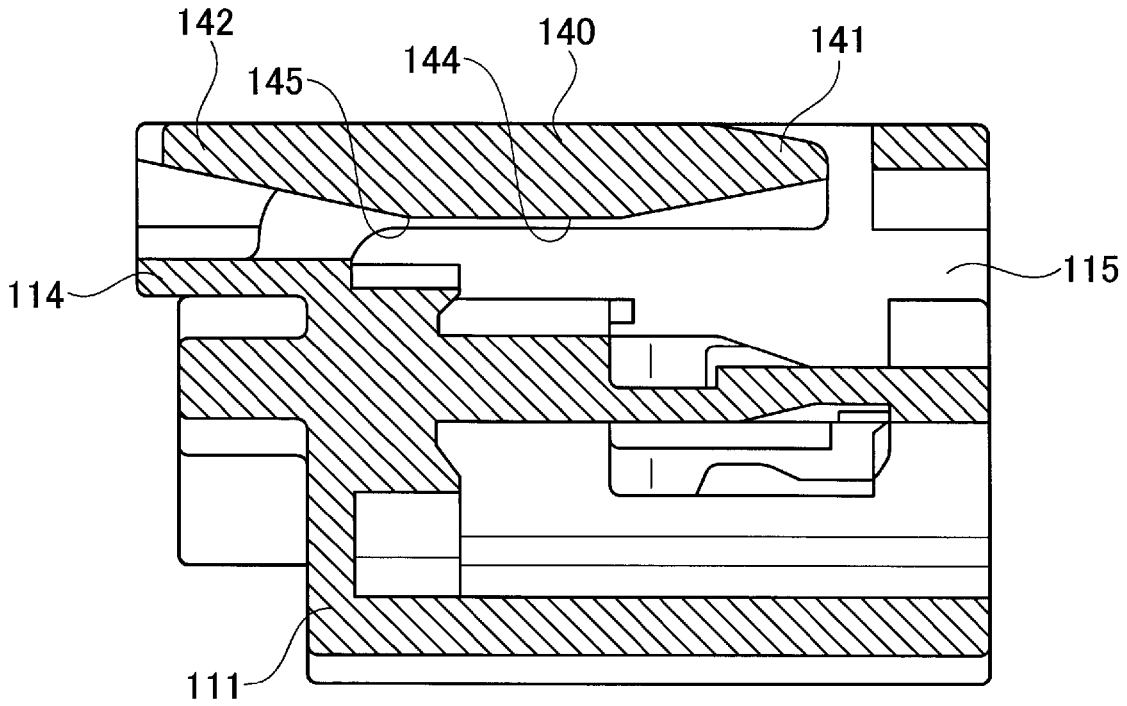
FIG. 9 is a cross-sectional view viewed along arrows E-E of FIG. 6C.
Figure 10B:
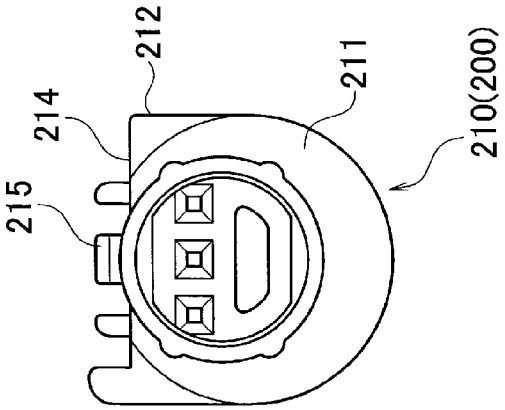
FIGS. 10A, 10B, and 10C are a side view, a front view, and a rear view of a configuration of a second connector housing in which a locking protrusion included in the locking mechanism according to the embodiment of the present invention is arranged, respectively.
Figure 10A:
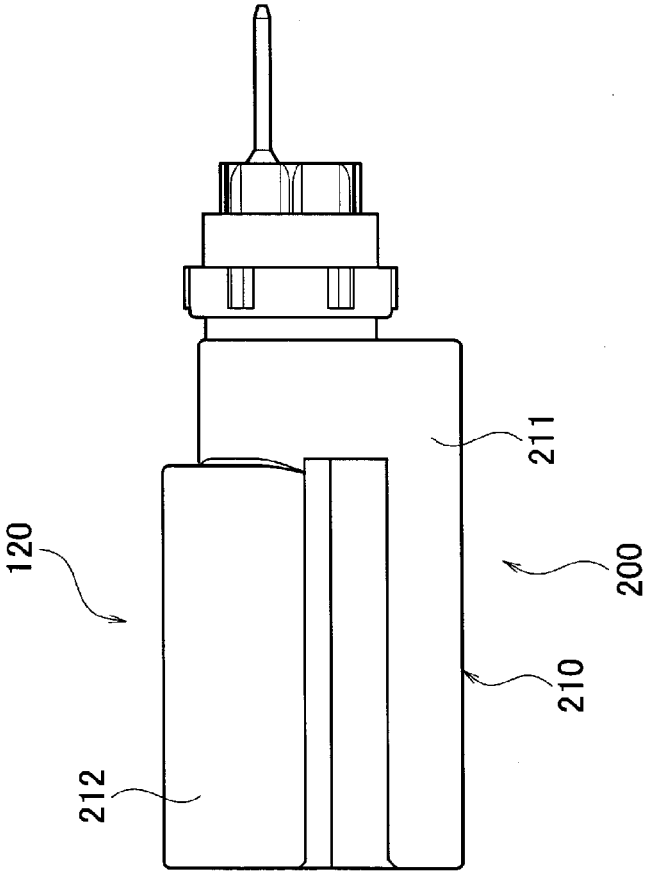
Figure 10C:
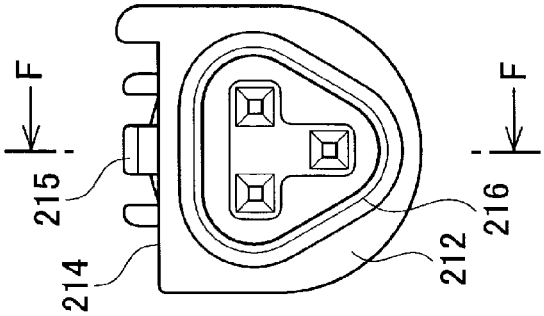
Figure 11:
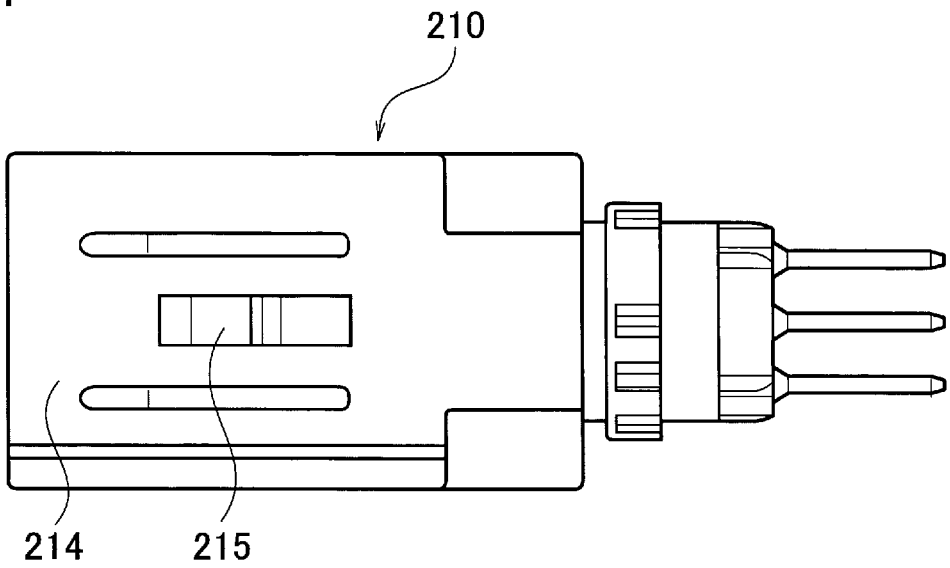
FIG. 11 is a top view of the second connector housing.
Figure 12:
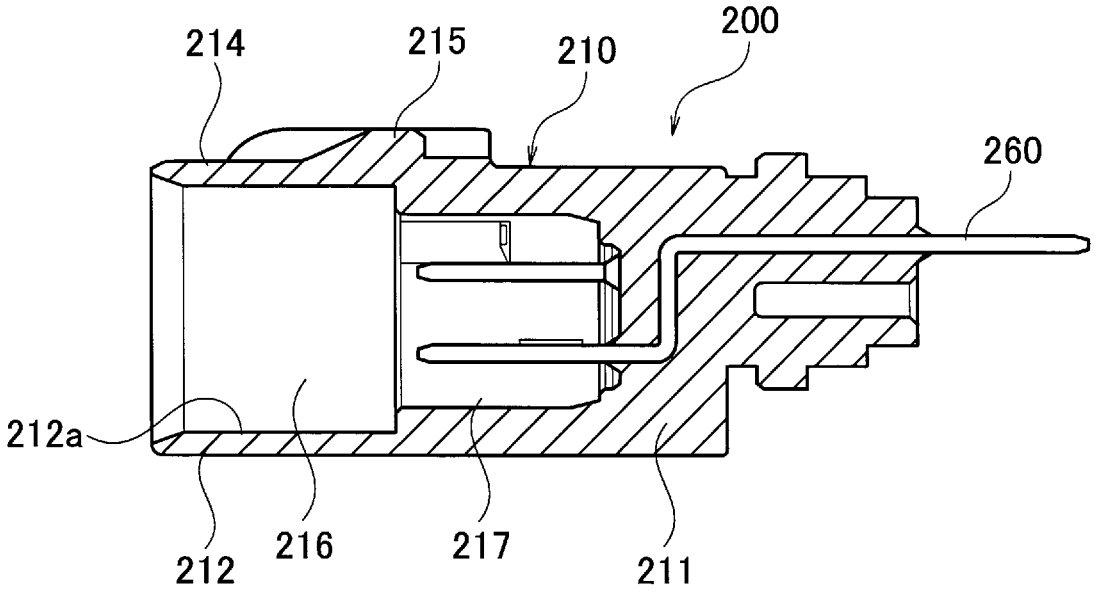
FIG. 12 is a cross-sectional view viewed along arrows F-F of FIG. 10C.

FIG. 1 is a perspective view of a connector including a locking mechanism according to the embodiment when the connector fits. FIG. 2 is a side view of the connector when the connector fits. FIG. 3 is a view on arrow A of FIG. 2. FIG. 4 is a cross-sectional view viewed along arrows B-B of FIG. 2. FIG. 5 is a cross-sectional view viewed along arrows C-C of FIG. 3. FIGS. 6A, 6B, and 6C are a side view, a front view, and a rear view of a configuration of a first connector housing in which a locking arm included in the locking mechanism is arranged, respectively. FIG. 7 is a top view of the first connector housing. FIG. 8 is a cross-sectional view viewed along arrows D-D of FIG. 6C. FIG. 9 is a cross-sectional view viewed along arrows E-E of FIG. 6C. FIGS. 10A, 10B, and 10C are a side view, a front view, and a rear view of a configuration of a second connector housing in which a locking protrusion included in the locking mechanism is arranged. FIG. 11 is a top view of the second connector housing. FIG. 12 is a cross-sectional view viewed along arrows F-F of FIG. 10C.

As illustrated in FIGS. 1 to 5, the locking mechanism is arranged between the first connector housing 110 of a first connector 100 and the second connector housing 210 of a second connector 200. The locking mechanism includes a locking arm 130 arranged toward the first connector housing 110 and a locking protrusion 215 arranged toward the second connector housing 210.

For convenience, a fitting direction and a fitting releasing direction between the first connector housing 110 and the second connector housing 210 as longitudinal direction and directions perpendicular to the longitudinal direction and perpendicular to each other as vertical direction and lateral direction will be described. Note that, three pairs of directions to be illustrated (front, rear, left, right, up, and down) are based on the first connector housing 110.

As illustrated in FIGS. 6A to 9, the locking arm 130 is arranged on the upper side of an upper wall 114 of a housing body 111 of the first connector housing 110 so as to be flexible in the vertical direction. An annular groove 115 that includes an opening facing forward, is arranged on the housing body 111. A terminal housing chamber 112 that houses a female terminal (not illustrated), is arranged inside the annular groove 115. An insertion hole 113 for a male terminal of the other side is arranged at a front end of each terminal housing chamber 112. A fitting hood portion 212 of the second connector housing 210 to be described later is inserted into the annular groove 115.

Meanwhile, as illustrated in FIGS. 10A to 12, the locking protrusion 215 is arranged so as to protrude on the upper side of an upper wall portion of the fitting hood portion 212 of the second connector housing 210. The locking protrusion 215 engages with the locking arm 130 by using flexure of the locking arm 130 when the first connector housing 110 and the second connector housing 210 fit into each other. In an engaging state illustrated in FIG. 5, the locking protrusion 215 generates locking force for preventing the first connector housing 110 and the second connector housing 210 from moving in the fitting releasing direction (backward).

A male terminal 260 is embedded in a housing body 211 of the second connector housing 210. A top end of the male terminal 260 protrudes in an inner portion 217 of a fitting recess portion 216.

As illustrated in FIG. 5, when the first connector housing 110 and the second connector housing 210 fit into each other, a top end of the housing body 111 of the first connector housing 110 fits into the fitting recess portion 216 of the second connector housing 210 and the inner portion 217 thereof. Accordingly, the top end of the male terminal 260 is inserted into a female terminal (not illustrated) through the insertion hole 113.

Upon the fitting, the fitting hood portion 212 of the second connector housing 210 is inserted into the annular groove 115 of the first connector housing 110. An internal circumferential wall 212*a* of the fitting hood portion 212 comes in contact with a packing 190 attached on an internal circumferential wall of the annular groove 115. Accordingly, a terminal connecting portion of the male terminal 260 and the female terminal (not illustrated) are sealed for waterproofing.

In the fitting state, the upper wall portion of the fitting hood portion 212 of the second connector housing 210 is arranged so as to be positioned on the lower side of the locking arm 130 toward the first connector housing 110.

As illustrated in FIGS. 7 to 9, the locking arm 130 includes a plate-like first arm 132 and a second arm 140. The plate-like first arm 132 corresponds to a locking arm body. The second arm 140 corresponds to a lock releasing arm and is integrally formed so as to bend back from a top end of the first arm 132.

The first arm 132 is a cantilever arm that extends a free end 134 forward from a fixing end 131 that has been fixed on the upper wall 114 of the first connector housing 110. The free end 134 is displaceable in the vertical direction due to flexibility of the arm.

The second arm 140 includes a loading end 141, an operating end 142, and a supporting portion 145. The loading end 141 to be a point of load of a lever is coupled to the free end 134 of the first arm 132. The operating end 142 to be a point of effort of the lever extends backward from the loading end 141 so as to be arranged at a rear end. The supporting portion 145 to be a fulcrum of the lever is arranged on a lower surface between the operating end 142 and the loading end 141. The supporting portion 145 is positioned at a rear-end corner of a flat surface 144 of a lower surface of the second arm 140.

The free end 134 of the first arm 132 includes an engaging recess portion 133 and a locking wall portion 135. The locking protrusion 215 toward the second connector housing 210 engages with the engaging recess portion 133. The locking wall portion 135 is positioned on the front side of the engaging recess portion 133. The loading end 141 of the second arm 140 is integrally formed with the locking wall portion 135 arranged at the free end 134 of the first arm 132.

The locking wall portion 135 of the first arm 132 slides with respect to the locking protrusion 215 in accordance with a fitting between the first connector housing 110 and the second connector housing 210. The first arm 132 bends upward so that the free end 134 of the first arm 132 is displaced upward. In accordance with progress of the fitting between the first connector housing 110 and the second connector housing 210, the locking wall portion 135 further gets over the locking protrusion 215. The locking protrusion 215 engages with the engaging recess portion 133 due to return operation of the flexure of the first arm 132 after the locking wall portion 135 of the first arm 132 gets over the locking protrusion 215. Accordingly, the locking wall portion 135 of the first arm 132 serves to generate locking force for preventing the first and second connector housings 110 and 210 from being detached, between the locking wall portion 135 of the first arm 132 and the locking protrusion 215.

As illustrated in FIG. 5, the locking mechanism presses the operating end 142 of the second arm 140 down as illustrated in an arrow F1 so as to rock the second arm 140 with, as a fulcrum P, a contact point with a working face 214 on the second connector housing 210 of the supporting portion 145. Leverage of the second arm 140 lifts the free end 134 (locking wall portion 135) of the first arm 132 coupled to the loading end 141 on the opposite side of the operating end 142 interposing the fulcrum P so as to release the engagement of the locking protrusion 125 with respect to the engaging recess portion 133.

In this case, the working face 214 of the supporting portion 145 of the second arm 140 is arranged on an upper surface of an upper wall of the fitting hood portion 212 of the second connector housing 210. The fitting hood portion 212 fits into an external circumference of a housing body 111 of the first connector housing 110. In the locking mechanism, a pair of the second arms 140 are arranged on both outsides of the first atm 132 in the lateral direction. Operating ends 142 of the pair of the second arms 140 are integrally coupled to each other. The working face 214 of the supporting portion 145 of each of the pair of the second arms 140 is arranged so as to be a plane perpendicular to a pressing-down direction of the operating end 142 of the second arm 140.

Note that, before releasing operation, the supporting portion 145 of the second arm 140 floats with a gap with respect to the working face 214 on the second connector housing 210. When the releasing operation is performed, the supporting portion 145 of the second arm 140 abuts on the working face 214 on the second connector housing 210 so as to serve as the fulcrum P of the rocking.

As illustrated in FIG. 1, a protecting frame 120 including a front wall 121 and both-sides walls 122 is arranged around the locking arm 130.

When the first connector 100 and the second connector 200 that include the above locking mechanism fit into each other, the locking wall portion 135 of the first arm 132 slides with respect to the locking protrusion 215 in accordance with a fitting between the first connector housing 110 and the second connector housing 210. The first arm 132 bends upward so that the free end 134 of the first arm 132 is displaced upward. When the first connector housing 110 and the second connector housing 210 further fit into each other, in accordance with progress of the fitting, the locking wall portion 135 of the first arm 132 gets over the locking protrusion 215. The locking protrusion 215 engages with the engaging recess portion 133 due to return operation of the flexure of the first arm 132 after the locking wall portion 135 of the first arm 132 gets over the locking protrusion 215. Accordingly, locking force for preventing the first and second connector housings 110 and 210 from being detached is generated between the locking protrusion 215 and the locking wall portion 135. The first connector 100 and the second connector 200 lock each other.

In order to release the lock in the state, as illustrated in FIG. 5, the operating end 142 of the second arm 140 of the locking arm 130 is pressed down as illustrated in an arrow F1. In this case, the supporting portion 145 of the second arm 140 comes in contact with the working face 214 of the second connector housing 210. The free end 134 (locking wall portion 135) of the first arm 132 coupled to the loading end 141 of the second arm 140, lifts with the contact point as the fulcrum P and then the lock is released.

In this case, the working face 214 of the supporting portion 145 of the second arm 140 is arranged on the upper surface of the upper wall of the fitting hood portion 212 of the second connector housing 210 and is not arranged on the first connector housing 110 including the locking arm 130. The fitting hood portion 212 fits with respect to the first connector housing 110. Accordingly, a position of the fulcrum P that rocks the second arm 140 can be arranged at a position that is away from the operating end 142 as a point of effort and is close to the loading end 141 as a point of load.

Therefore, a distance H1 between the operating end (point of effort) 142 that adds pressing-down operating force for releasing the lock, and the fulcrum P can be arranged so as to be long. A distance H2 between the loading end (point of load) 141 coupled to the locking wall portion 135 of the free end 134 of the first arm 132, and the fulcrum P can be arranged so as to be short. As a result, a lever ratio (H1/H2) can increase and the operating force for releasing the lock (operating force as illustrated in the arrow F1) can be reduced. Workability for releasing the lock can be improved.

In particular, the working face 214 is arranged so as to be on the upper surface of the upper wall of the fitting hood portion 212 of the second connector housing 210. Thus, with a simple change of the configuration, the distance H1 between the point of effort (operating end 142) and the fulcrum (supporting portion 145) can be arranged so as to be as long as possible. The distance H2 between the point of load (loading end 141) and the fulcrum (supporting portion 145) can be arranged so as to be as small as possible. Upon the release of the lock, the operating force can be further reduced.

Figure 13:
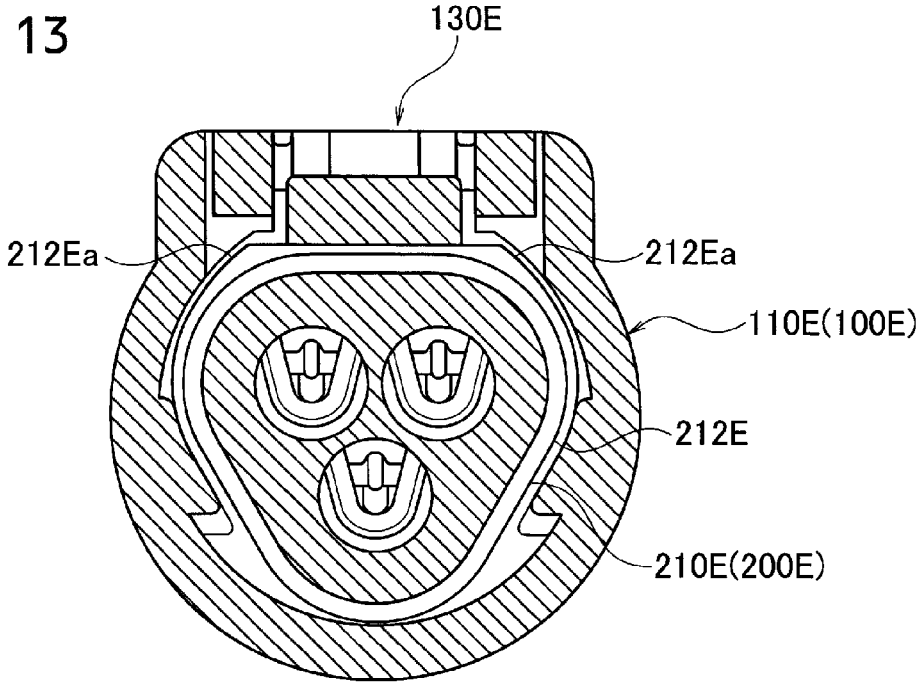
FIG. 13 is a cross-sectional view of a connector according to a comparative example when the connector fits, the connector being developed before the embodiment of the present invention, and the cross-sectional view being similar to FIG. 4.
Figure 14:
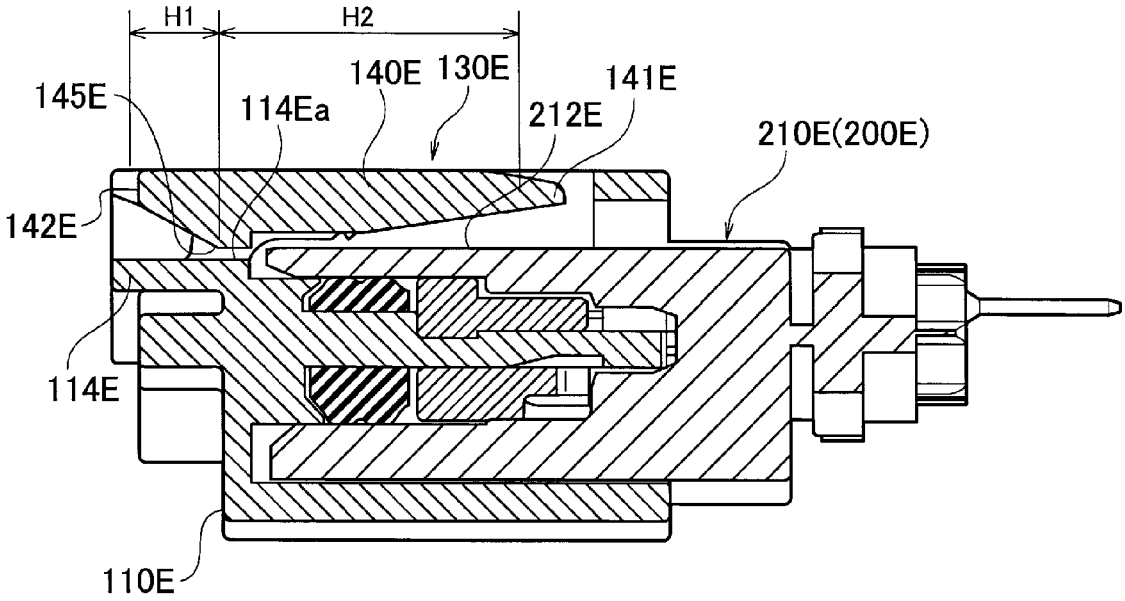
FIG. 14 is a cross-sectional view of the connector according to the comparative example when the connector fits, the connector being developed before the embodiment of the present invention, and the cross-sectional view being similar to FIG. 5.
Figure 15:
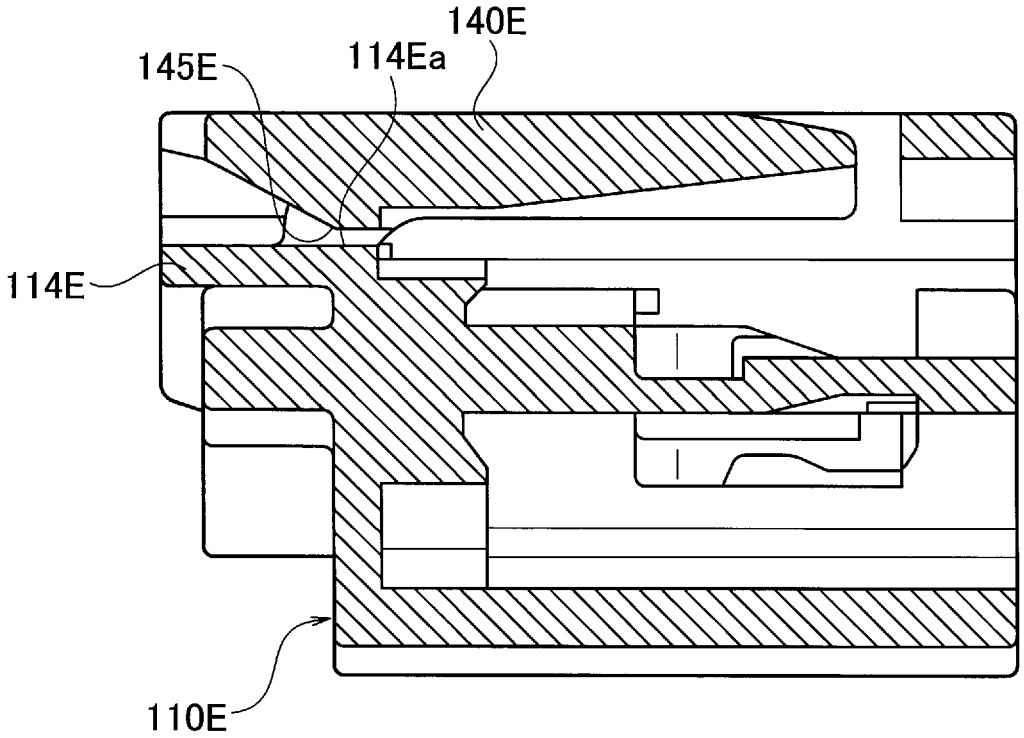
FIG. 15 is a cross-sectional view of a configuration of the connector toward a first connector housing according to the comparative example, the connector being developed before the embodiment of the present invention, and the cross-sectional view being similar to FIG. 9.

This point will be described with comparison with a comparative example illustrated in FIGS. 13 to 15.

Elements similar to those in the embodiment are denoted with "E" plus the same reference signs (numerals) as the embodiment. A difference between the embodiment and the comparative example is only a shape or a size.

In this comparative example, a working face 114Ea of a supporting portion 145E of a second arm 140E of a locking arm 130E toward a first connector 100E (toward a first connector housing 110E) is arranged on an upper surface of an upper wall 114E of the first connector housing 110E, and is not arranged on a fitting hood portion 212E of a second connector housing 210E. A position 212Ea that corresponds to a working face of the fitting hood portion 212E, is formed so as to have a curved surface.

With the configuration, a distance H1 between a fulcrum (supporting portion 145E) and a point of effort (operating end 142E) tends to be short. Therefore, the distance H1 between the fulcrum (supporting portion 145E) and the point of effort (operating end 142E) shortens. A distance H2 between a point of load (loading end 141E) and the fulcrum (supporting portion 145E) lengthens. Therefore, operating force for releasing a lock increases and workability for releasing the lock degrades.

Figure 16:
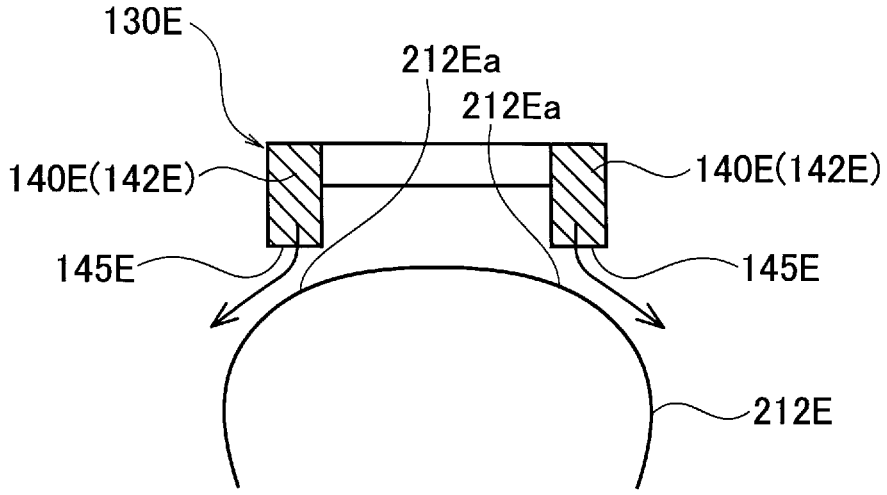
FIG. 16 is a cross-sectional view for describing a problem according to the comparative example.

In order to simply move the working face of the supporting portion 145E forward, it is examined that the working face of the supporting portion 145E is arranged so as to be on the upper wall of the fitting hood portion 212E of the second connector housing 210E. However, the curved surface (212Ea) is formed on the upper wall of the fitting hood portion 212E. Thus, simply moving the position of the working face to the position 212Ea causes a risk that a working position of the supporting portion 145E slips and moves in a case where the operating end 142E is pressed down as illustrated in FIG. 16. When the working position moves, a lifting margin of the loading end 141E of the second arm 140E becomes unstable.

Figure 17:
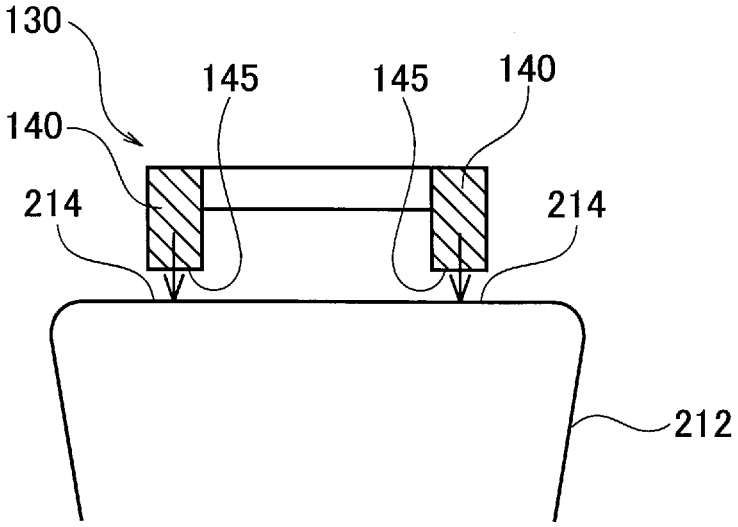
FIG. 17 is a cross-sectional view for describing an effect according to the embodiment of the present invention.
Figure 18:
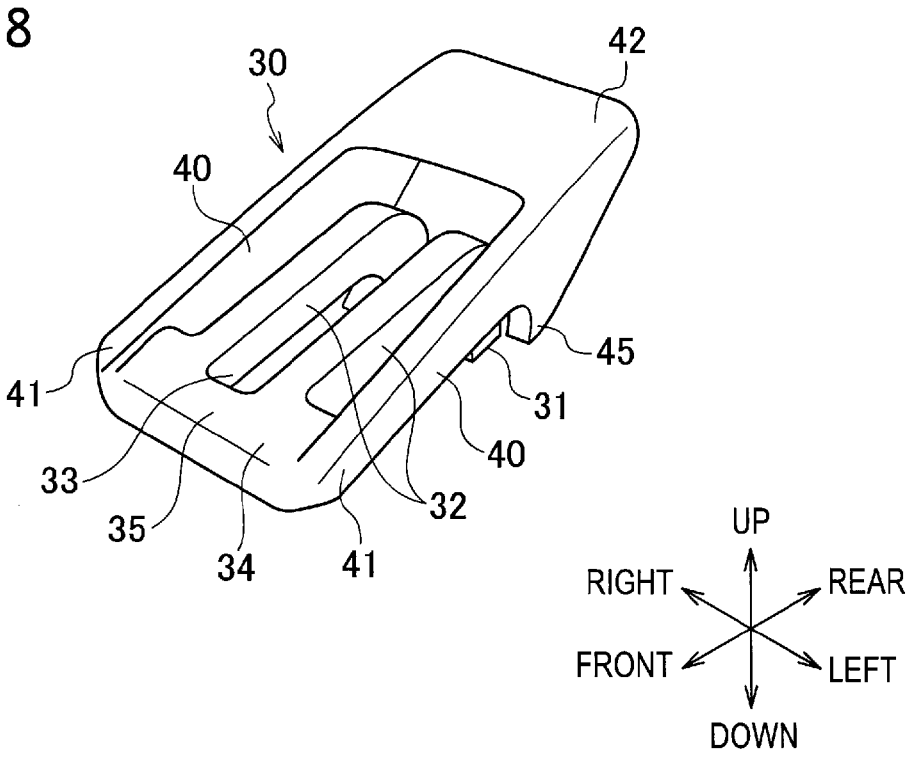
FIG. 18 is a view for describing a locking mechanism in the related art and is a perspective view of an external configuration of a locking arm only taken out.
Figure 19:
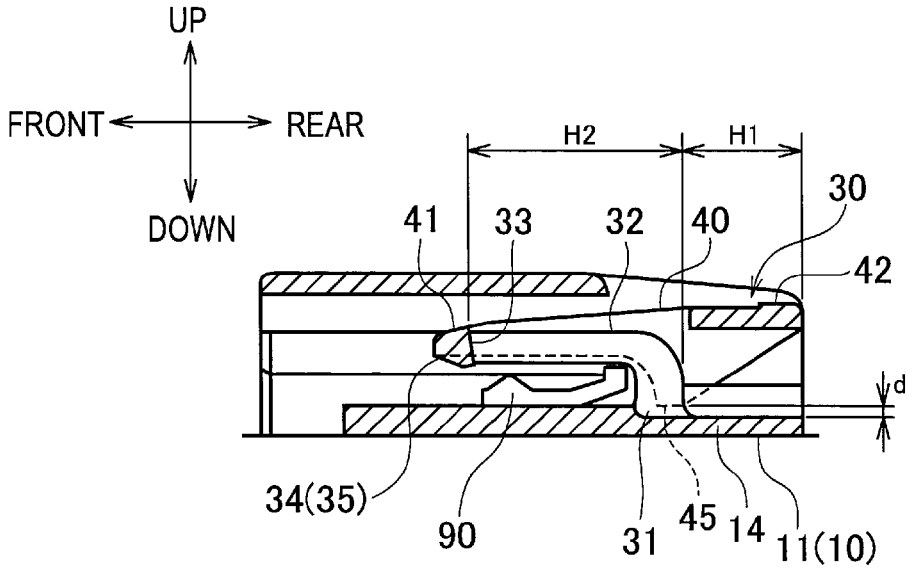
FIG. 19 is a view for describing the locking mechanism in the related art and is a partial longitudinal cross-sectional view of a first connector housing including the locking arm of FIG. 18 arranged therein.
Figure 20A:
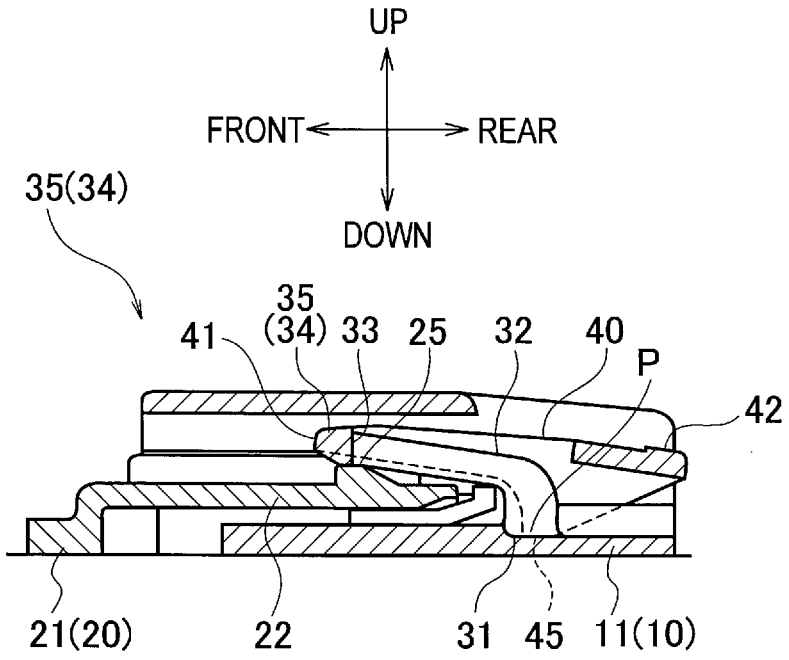
FIGS. 20A and 20B are views for describing the locking mechanism in the related art and are partial longitudinal cross-sectional views illustrating the first connector housing and a second connector housing that have fitted into each other and the first connector housing and the second connector housing that have been detached from each other, respectively.
Figure 20B:
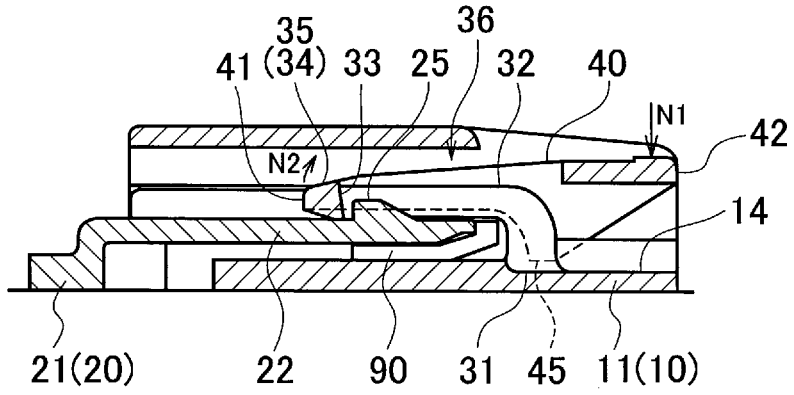

In contrast, in the present embodiment, as illustrated in FIG. 17, the working face 214 of the supporting portion 145 of the second arm 140 is arranged so as to be a plane. Thus, a working position hardly moves, and a pulling-up margin of the free end 134 (locking wall portion 135) of the first arm 132 for releasing the lock does not vary. Therefore, the first arm 132 can be stably pulled up upon the release of the lock, and the lock can be stably released. Even when the working position of the supporting portion 145 of the second arm 140 moves, since the pulling-up margin of the free end 134 (locking wall portion 135) of the first arm 132 for releasing the lock is stably secured, stability of lock releasing operation can be achieved.

What is claimed is:

1. A connector locking mechanism in which an operating end of a second arm is pressed down so as to swing the second arm by utilizing a contact point as a fulcrum where the contact point being arranged on a supporting portion to be in contact with a working face on a second connector housing and to be opposed to the working face, and so as to lift a free end of a first arm utilizing leverage of the second arm where the free end of the first arm is coupled to a loading end on an opposite side of the operating end interposing the fulcrum, and release engagement of a locking protrusion with respect to an engaging recess portion, comprising:

in a case where a fitting direction and a fitting releasing direction of a first connector housing and the second connector housing that fit into each other are defined as longitudinal direction and directions that are perpendicular to the longitudinal direction and are perpendicular to each other are defined as vertical direction and lateral direction, a locking arm arranged on an upper side of an upper wall of the first connector housing so as to be flexible in the vertical direction; and the locking protrusion arranged so as to protrude on an upper side of an upper wall of the second connector housing, configured so as to engage with the locking arm using flexure of the locking arm when the first connector housing and the second connector housing fit into each other, and configured so as to generate locking force for preventing the first connector housing and the second connector housing from moving in the fitting releasing direction in the engaging state, wherein the locking arm integrally includes:

a first arm formed in a cantilever shape and extending the free end forward from a fixing end fixed on the upper wall of the first connector housing so that the free end is displaceable in the vertical direction due to flexibility of the first arm; and the second arm in which:

the loading end to be a point of load of a lever at the free end of the first arm is coupled to the second arm;

the operating end extends backward from the loading end, and is arranged so as to be a point of effort of the lever at a rear end; and the supporting portion is arranged so as to be the fulcrum of the lever on a lower surface between the operating end and the loading end, the free end of the first arm includes:

the engaging recess portion configured to engage with the locking protrusion; and an engaging wall portion positioned on a front side of the engaging recess portion, configured to slide with respect to the locking protrusion in accordance with a fitting between the first connector housing and the second connector housing so that the first arm bends upward and the free end of the first arm is displaced upward, configured to get over the locking protrusion in accordance with progress of the fitting between the first connector housing and the second connector housing, and configured to engage the locking protrusion with the engaging recess portion due to return operation of the flexure of the first arm after the engaging wall portion gets over the locking protrusion so as to generate the locking force between the locking protrusion and the engaging wall portion, and the working face opposed to the supporting portion of the second arm is arranged on an upper surface of the upper wall of the second connector housing, the upper wall of the second connector housing to be fitted to the first connector housing.

2. The connector locking mechanism according to claim 1, wherein the working face opposed to the supporting portion of the second arm is arranged on an upper surface of an upper wall of a fitting hood portion formed on the second connector housing, the fitting hood portion fitting the second connector housing into an external circumference of a housing body of the first connector housing.

3. The connector locking mechanism according to claim 1, wherein a pair of the second arms are arranged on both outsides of the first arm in the lateral direction, operating ends of the pair of the second arms are integrally coupled to each other, and the working face opposed to the supporting portion of each of the pair of the second arms is arranged so as to be a plane perpendicular to a pressing-down direction of the operating end of each of the second arms.

* * * * *